United States Patent [19]

Molsberger

[11] 4,199,276

[45] Apr. 22, 1980

[54] OFFSHORE LIFT PLATFORM

[75] Inventor: Hans-Günther Molsberger, Hamburg, Fed. Rep. of Germany

[73] Assignee: Howaldtswerke-Deutsche Werft Aktiengesellschaft Hamburg und Kiel, Kiel, Fed. Rep. of Germany

[21] Appl. No.: 933,405

[22] Filed: Aug. 14, 1978

[30] Foreign Application Priority Data

Aug. 16, 1977 [DE] Fed. Rep. of Germany ..... 2736938

[51] Int. Cl.[2] ..... E02B 17/08

[52] U.S. Cl. ..... 405/198; 254/107

[58] Field of Search ..... 405/197, 198, 199, 200, 405/196; 254/108, 107, 106, 105

[56] References Cited

U.S. PATENT DOCUMENTS

| | | | |
|---|---|---|---|
| 2,822,670 | 2/1958 | Suderow | 405/197 |
| 3,495,806 | 2/1970 | Sutton | 405/198 |

FOREIGN PATENT DOCUMENTS

| | | | |
|---|---|---|---|
| 1078607 | 8/1967 | United Kingdom | 405/196 |

*Primary Examiner*—David H. Corbin

*Attorney, Agent, or Firm*—John C. Smith, Jr.

[57] ABSTRACT

An offshore lift platform comprises a platform proper with a plurality of support legs arranged shiftable. Each leg is retained through the intermediary of latch hole rows arranged in horizontal and vertical spacings and advance means climbing in increments in that at the platform in the spacing of the latch hole rows upper and lower latches are arranged above one another. The lower latches are stationarily positioned at the platform. The upper latches are arranged height-adjustable relative to the platform via a positioner and are interconnected via a ring. The ring is formed by individual segment-like ring portions which are pivotally connected to one another. Each ring portion receives an upper latch. The lower latches are arranged height-adjustable via positioners.

8 Claims, 4 Drawing Figures

OFFSHORE LIFT PLATFORM

BACKGROUND OF THE INVENTION

This invention relates to an offshore lift platform, comprising a platform proper with a plurality of support legs arranged shiftable, each leg being retained through the intermediary of latch hole rows arranged in horizontal and vertical spacings and advance means climbing in increments in that at the platform in the spacing of the latch hole rows latches are arranged above one another and the lower latches are stationarily positioned at the platform, whereas the upper latches are arranged height-adjustable relative to the platform via a positioner and are interconnected via a ring.

Mobile offshore structures of this type correspond to the so-called "jack up" principle, the platform being built as buoyant body and the legs or columns being held in the or at the platform via latches and being movable in vertical direction via advance means. For doing so, the latches in the upper row are withdrawn from the sockets of the legs and shifted by means of hydraulic cylinders into the next higher or lower latch hole row. Subsequently, the lower row of latches is withdrawn from the sockets, and by means of the hydraulic cylinders a corresponding movement of the platform is effected, and the latches are reengaged with the leg.

Such apparatus are already known from German Auslegeschrift No. 2,549,746. It has been noted, however, that for large dimensions of the legs it is extremely difficult and very costly in manufacturing aspects to in particular tolerate the vertical spacings of the latch hole rows so closely as would be required in order to achieve a uniform loading of the individual latches.

SUMMARY OF THE INVENTION

It is the object of the present invention to avoid this disadvantage and to provide an offshore lift platform which maintains the required manufacturing tolerances of the spacings of the latch hole rows in economically acceptable limits and insures a uniform flux of force from the legs via the latch hole walling and latches to the platform.

According to the invention, it is provided for that the ring is defined by individual segment-like ring portions and each ring portion receives an upper latch, and that the lower latches are arranged height-adjustable via positioners.

It is permitted by this arrangement of effecting an adaptation to the spacings and in doing so causing a uniform loading of the latches.

For a simple configuration of the pivot connection, it is furthermore proposed that the pivot connection between adjacent ring portions is defined by respectively parallel shiftably arranged slide blocks and interconnected by a link.

A further advantage of the invention that the lower latches are arranged height-adjustable via short-stroke cylinders arranged at both sides.

In order to provide for a uniform load distribution for all latches, it is proposed that the positioners for the upper and lower latches are formed as hydraulic cylinders and each latch row is interconnectible.

BRIEF DESCRIPTION OF THE DRAWINGS

An embodiment of the invention will now be described by way of example and with reference to the accompanying semi-diagrammatic drawings, in which.

DESCRIPTION OF THE PREFERRED EMBODIMENT

Figure 1:
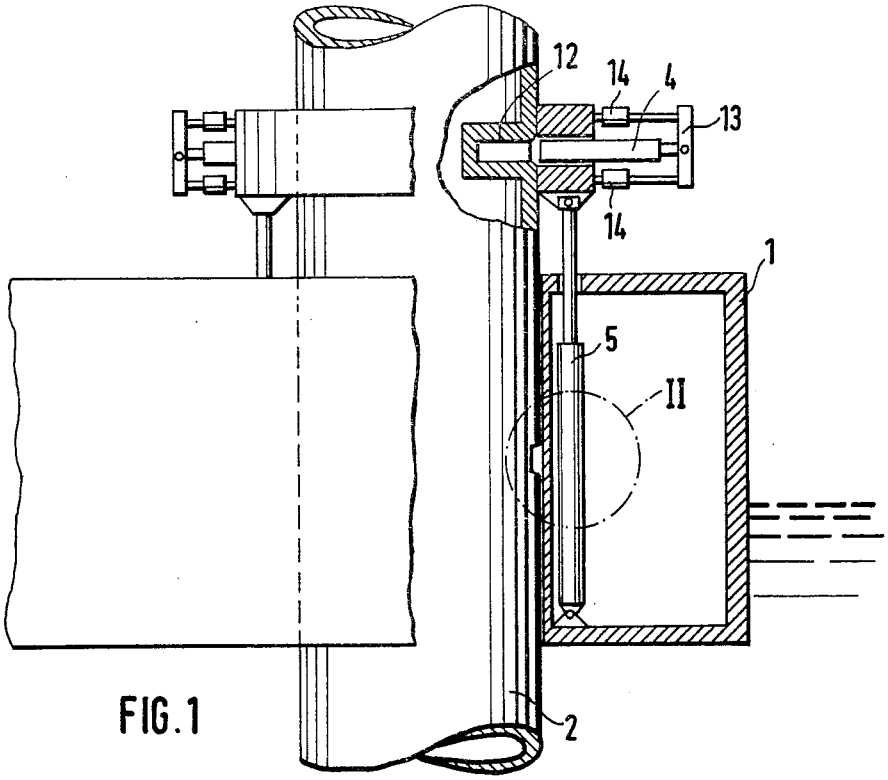
FIG. 1 is a platform portion with a support leg.

FIG. 1 shows an offshore lift platform according to the invention which substantially comprises a platform proper 1 and a plurality of shiftably arranged support legs 2. Each support leg 2 possesses horizontal and vertical latch hole rows. At the platform 1, stationarily lower latches 3 (FIG. 2) as dead-stroke latches or stationary latches are provided. Furthermore, upper latches 4 are arranged height-adjustable relative to the platform 1 via a hydraulic cylinder 5 and operate as work-stroke latches and are interconnected via a ring 6 as shown in FIG. 3. The ring 6 is defined by segment-like ring portions 7, each ring portion 7 receiving an upper latch 4. Each upper latch 4 is retained via a transverse yoke 13 and operable via control cylinders 14 arranged at both sides.

Figure 4:
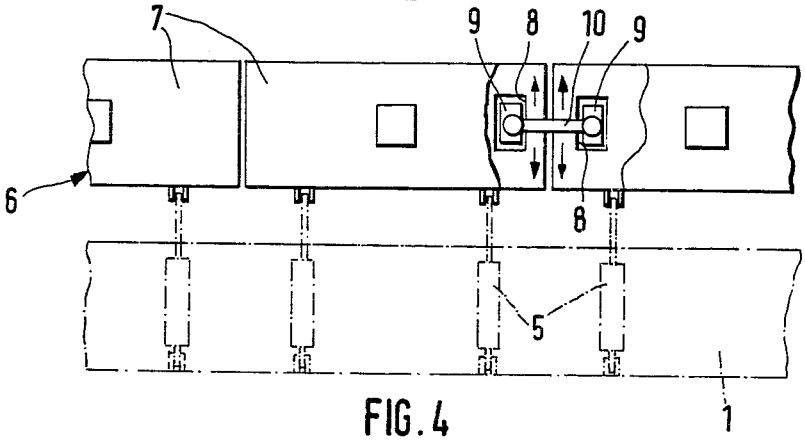
FIG. 4 is a side elevantional view of a development of the ring according to FIG. 3.

The individual ring portions 7 are intercoupled via a pivot connection in that each ring portion 7 has slide blocks 9 (FIG. 4) arranged parallel shiftable in a guide 8, said blocks being interconnected by a link 10.

Figure 2:
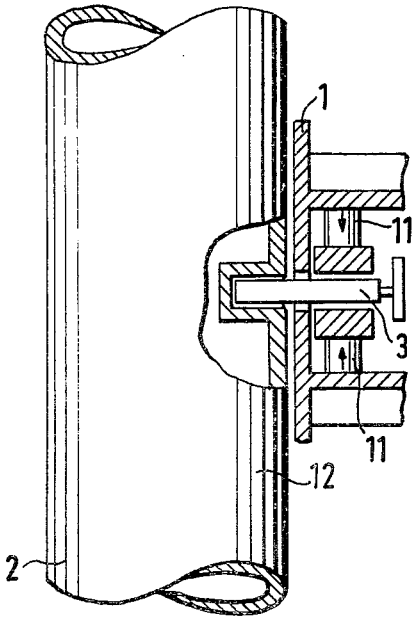
FIG. 2 is a lower latch according to the detail II of FIG. 1.
Figure 3:
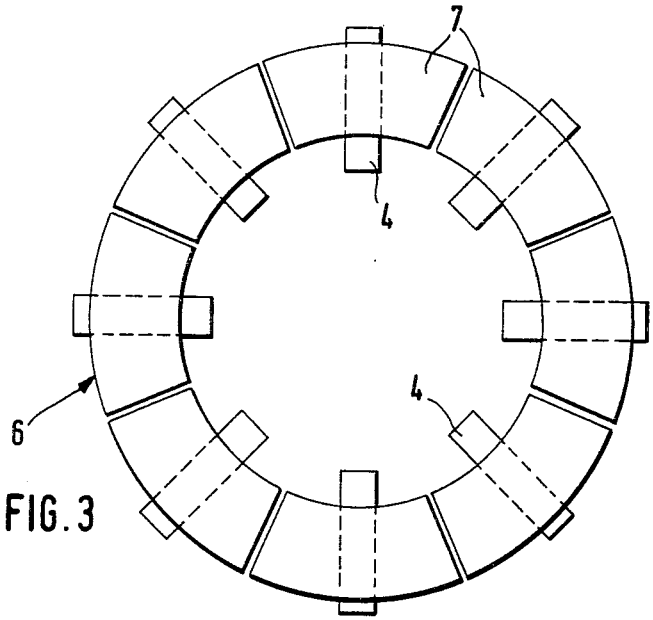
FIG. 3 is plan view of the ring of segment-like ring portions with upper latches.

The lower latches 3 are arranged height-adjustable via short-stroke cylinders 11 arranged at both sides (FIG. 2).

The lowering of each support leg 2 relative to the platform 1 is effected as follows:

The ring 6 connected to the leg 2 via the upper latches 4 is moved downwardly in direction of the upper deck of the platform 1 by retracting the hydraulic cylinder 5. After the hydraulic cylinder 5 has reached its extreme position, the lower latches 3 are connected to the sockets 12 of the next row of holes. Subsequently, the upper latches 4 are disengaged so that the ring 6 is released from the leg 2. By extending the hydraulic cylinder 5, the ring 6 is moved upwardly until its upper extreme position is reached. Then the upper latches 4 are again connected to the leg 2 via the sockets 12, and the lower latches 3 are released again, so that the same cycle is repeated.

When the columns have been extended so far that they have settled on the sea floor, upon continuation of the movement procedure described the buoyant body is lifted out of the water. It is of course required that the vertical pitch of the latch hole rows corresponds to the stroke length of the hydraulic cylinder 5.

Subsequently, by an interconnection of the hydraulic cylinders 5 or the short-stroke cylinders 11 it is provided for that all upper latches 4 or lower latches 3 are uniformly loaded and thus each latch receives the same loading.

The invention may be embodied in other specific forms without departing from the spirit or the essential characteristics thereof. The embodiment therefore is to be considered in all respects as illustrative and not restrictive.

What is claimed is:

1. An offshore structure comprising:

(a) a platform;

(b) a plurality of elongated support legs, each having a plurality of sockets arranged at spaced intervals substantially in horizontal and vertical rows;

(c) a plurality of first latches mounted on said platform, arranged about each support leg and adapted to releasably engage a horizontal row of said sockets in the associated support leg;

(d) a plurality of second latches arranged about each support leg, and adapted to releasably engage a horizontal row of said sockets in the associated support leg spaced from the horizontal row of sockets engaged by said first latches;

(e) means for engaging and disengaging each of said first and second latches to and from horizontal rows of sockets and means for moving each of said second latches along the respective support leg towards and away from the respective first latch, whereby each of said second latches may be caused to disengage a socket, move along the respective support leg and engage a further socket in the respective vertical row of sockets and each of said first latches may be caused to disengage a socket, move along the respective support leg and engage a further socket in the respective vertical row of sockets to advance said platform with respect to said support legs; and (f) means interconnecting said plurality of second latches about each support leg and spaced from said platform, said interconnecting means comprising a plurality of segments, each mounted on one of said second latches and means pivotally connecting adjacent of said segments; whereby said latches are uniformly loaded when engaging a horizontal row of sockets in said support leg.

2. An offshore structure as set forth in claim 1 wherein each of said pivotal connecting means comprises substantially vertically slidable means on each of said segments and a plurality of links, each link extending between said substantially vertically slidable means on adjacent segments.

3. An offshore structure as set forth in claim 2 wherein each of said slidable means comprises guide means mounted on a segment and a block slidable along said guide means, each end of each of said links being connected to one of said blocks.

4. An offshore structure as set forth in claim 1 further comprising means for adjusting the height of each of said first latches relative to said platform.

5. An offshore structure as set forth in claim 1 wherein said means for moving said first and second latches towards and away from each other comprises a plurality of hydraulic cylinders, each extending between a first latch and a second latch.

6. An offshore structure as set forth in claim 4 wherein said means for moving said first and second latches towards and away from each other and said means for adjusting the height of said first latches relative to said platform comprises a plurality of hydraulic cylinders.

7. An offshore structure as set forth in claim 1 wherein said second latches and said interconnecting means are arranged above said first latches and platform.

8. An offshore structure as set forth in claim 1 wherein said interconnecting means comprises a segmented ring structure with linking means pivotally joining adjacent segments.

* * * * *